US006374735B1

(12) United States Patent
Satoh et al.

(10) Patent No.: US 6,374,735 B1
(45) **Date of Patent: *Apr. 23, 2002**

(54) PRINTING PLATE HAVING INTERDIGITATING MOUNTING LUGS, A PLATE CYLINDER, AND METHOD OF MOUNTING

(75) Inventors: Masayoshi Satoh; Shinji Kawashima, both of Kanagawa (JP)

(73) Assignee: Kabushiki Kaisha Tokyo Kikai Seisakusho, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/440,668

(22) Filed: Nov. 16, 1999

(30) Foreign Application Priority Data

Nov. 26, 1998 (JP) ..... 10-334852

(51) Int. Cl.[7] ..... B41F 27/12
(52) U.S. Cl. ..... 101/415.1; 101/376; 101/395
(58) Field of Search ..... 101/415.1, 378, 101/382.1, 383, 395, 483, 379, 380, 381, 368, 376

(56) References Cited

U.S. PATENT DOCUMENTS 1,231,968 A * 7/1917 Tallent et al. ..... 101/415.1
2,109,152 A * 2/1938 Meisel ..... 101/415.1
2,375,603 A * 5/1945 Willard ..... 101/415.1
2,668,498 A * 2/1954 Boyajean, Jr. ..... 101/415.1
2,684,029 A * 7/1954 Friesz et al. ..... 101/415.1
5,188,031 A * 2/1993 Depa et al. ..... 101/415.1
5,551,340 A * 9/1996 Bolza-Schunemann et al. .. 101/415.1
5,687,647 A * 11/1997 Vrotacoe et al. ..... 101/375

FOREIGN PATENT DOCUMENTS

JP 5-66264 9/1993
JP 8-58064 3/1996

* cited by examiner

*Primary Examiner*—Leslie J. Evanisko
(74) *Attorney, Agent, or Firm*—Rader, Fishman & Grauer, PLLC

(57) ABSTRACT

A plate cylinder has formed therein a groove extending parallel to the cylinder axis and having a depth direction thereof set at an angle to a plane tangent to the plate cylinder at the groove, so that the opposite sides of the groove are at acute and obtuse angles, respectively, to that plane. For use with this plate cylinder, the printing plate has two staggered series of spaced lugs formed on a pair of meeting edges of its image-bearing major part. The two series of lugs are bent at approximately the same acute and obtuse angles, respectively, to the major part as the opposite sides of the groove are to the tangential plane. For mounting the plate to the cylinder, the acute-angled series of lugs of the plate are first inserted in the groove in the cylinder so as to hook these lugs onto the acute-angled leading side of the groove. Then the plate is wrapped around the cylinder by rotating the same in a prescribed direction. Then the obtuse-angled series of lugs are inserted in the cylinder groove into an interdigitating relationship with the acute-angled series of lugs.

4 Claims, 4 Drawing Sheets

PRINTING PLATE HAVING INTERDIGITATING MOUNTING LUGS, A PLATE CYLINDER, AND METHOD OF MOUNTING

BACKGROUND OF THE INVENTION

This invention relates to the art of rotary printing and deals more specifically with how to mount a printing plate to a plate cylinder in a rotary printing press. Still more specifically, the invention concerns both the printing plate having two interdigitating series of spaced mounting lugs on its pair of meeting edges for use in mounting the plate to the plate cylinder, and the plate cylinder configured specifically for that printing plate in order to permit the same to be readily and undetachably mounted thereto.

Japanese Examined Patent Publication No. 5-66264 and Japanese Unexamined Patent Publication No. 8-58064 are hereby cited as teaching how to mount printing plates to plate cylinders. The former suggests a printing plate in the form of a rectangular sheet of a so-called "shape memorizing" alloy of any known or suitable composition. The printing plate is formed to include a rim bent inwardly along one of its pair of meeting edges. The bent rim is intended for engagement in a groove formed in the surface of the plate cylinder and extending parallel to the cylinder axis.

The printing plate "memorizes" the tubular shape of the required diameter it should take when wrapped around the plate cylinder. Therefore, supplied in flat form, the plate is to be heated, usually by application of heated air, while being mounted to the cylinder, until it rolls up and closely embraces the cylinder. The plate is said to stay firmly in place on the cylinder as the bent rim on only one of its meeting edges is engaged in the groove in the cylinder. The width of this groove may therefore be only somewhat more than the thickness of the printing plate.

Offsetting the advantages gained by this prior art printing plate are the drawbacks that arise from the same cause as do the advantages, the use of shape memorizing alloy material, which is more expensive than usual printing plate materials. The manufacturing cost of the printing plate has become even higher as the plate must be pretreated to "memorize" the tubular shape. Furthermore, in use of the printing plate, the printing press must be equipped with an attachment for application of heated airstream to the plate for deforming the same into the required shape each time such a plate is mounted to the plate cylinder. The attachment itself is costly and has added to the space requirement of the press as well as to its running costs.

All these disadvantages, and advantages too, of the first recited prior art are absent from the second mentioned document, Japanese Unexamined Patent Publication No. 8-58064. This second conventional printing plate takes the form of a rectangular piece of flexible sheet material, having a row of alternately bent and unbent lugs projecting from one of its meeting edges. Along the other of the meeting edges there are formed a series of bent lugs alternating with recesses which are shaped and sized to receive the unbent lugs on the first mentioned of the meeting edges. When the plate is wrapped around the plate cylinder, the bent lugs on both meeting edges come into face-to-face abutment against each other as they are received in a groove in the surface of the cylinder. Further, on the surface of the cylinder, the unbent lugs on the first meeting edge fit in the recesses in the second.

Being required to receive the two butting series of bent lugs on both meeting edges of the second prior art printing plate, the groove in the plate cylinder has had to be more than twice as wide as the thickness of the plate. The inconveniently wide groove has necessitated the provision of the unbent lugs on the first meeting edge, for partly closing the groove, and the creation of the recesses in the second meeting edge for receiving the unbent lugs.

So complex in shape and exacting in dimensions and locations, the meeting edge configurations of the second prior art printing plate were very difficult of production. They were, indeed, incapable of creation by the bending machines that had been more conventionally used for jointly bending the meeting edges of printing plates. A dedicated bending machine of complex, expensive construction had to be newly installed for production of printing plates according to the teachings of the second prior art.

It will of course be understood that the two noted conventional devices cannot possibly be combined to provide a printing plate that is free from the drawbacks of both devices. The first described prior art printing plate attains its simplicity of construction, and makes it possible to narrow the groove in the plate cylinder to a minimum, only at the cost of the expensive material in use. The complex meeting edge configurations of the second described prior art printing plate, and the resulting wider groove in the plate cylinder, have been the direct results, conventionally, of the cheaper material of which the plate is made. The two devices are contradictory and incompatible.

SUMMARY OF THE INVENTION

In view of the foregoing state of the art, the present invention has it as an object to provide a printing plate that can be made from inexpensive, ordinary printing plate materials and that is easy to fabricate with conventional, readily available machinery.

Another object of the invention is to provide a printing plate that is mountable to an associated plate cylinder having a groove comparable in width to that conventionally used with the shape memorizing printing plate.

Yet another object of the invention is to expedite the process of mounting a printing plate to a plate cylinder without use of any additional equipment to that end.

A further object of the invention is to provide a plate cylinder designed specifically for use with the printing plate, in order to permit the same to be readily and firmly mounted thereto.

Briefly summarized, the present invention provides a printing plate for use with a plate cylinder having formed therein a groove extending parallel to the cylinder axis. The printing plate is generally in the form of a piece of flexible sheet material integrally comprising an image-bearing major part having a pair of meeting edges which are to meet each other when the printing plate is wrapped around the plate cylinder, and two series of lugs formed on the meeting edges of the major part and bent with respect to the major part for engagement in the groove in the plate cylinder. The two series of lugs on the major part are capable of interfitting interengagement with each other in the groove in the plate cylinder.

Preferably, the groove in the plate cylinder has its depth direction set an angle to a plane tangent to the cylinder at the groove so that opposite sides of the groove are at acute and obtuse angles, respectively, to that tangential plane. In conformity with this angled groove, the two series of lugs of the printing plate are bent with respect to the major part at approximately the same acute and obtuse angles, respectively, as the opposite sides of the groove are to the tangential plane.

For mounting the printing plate to the plate cylinder, the acute-angled series of lugs of the plate are first inserted in the groove in the cylinder so as to hook these lugs onto the acute-angled trailing side of the groove. Then the plate is wrapped around the cylinder by rotating the same in a prescribed direction. Then the obtuse-angled series of lugs are inserted in the cylinder groove into an interdigitating relationship with the acute-angled series of lugs.

Being constructed and mounted to the plate cylinder as above, the printing plate according to this invention can be made from conventional printing plate materials instead of from shape memorizing, magnetic, or like expensive materials. The two staggered, bent rows of lugs of the printing plate are easy to fabricate with conventional machinery, and the completed printing plate is readily mountable to the plate cylinder, unaided by any additional equipment, without in any way adding to the toil of the operator.

It is to be noted that the two series of lugs on the mounting plate interdigitate or interfit in the cylinder groove, instead of butt against each other as in one of the cited prior art devices. Consequently, the cylinder groove can have a width less than twice the thickness of the printing plate, requiring no special means for closure of its entrance end against ink intrusion. And, the narrow cylinder groove reduces a mechanical shock between the blanket cylinder and the plate cylinder when the plate cylinder is rotating, thereby a high speed printing and a high quality print are performed.

The above and other objects, features and advantages of this invention and the manner of achieving them will become more apparent, and the invention itself will best be understood, from a study of the following description and attached claims, with reference had to the accompanying drawings showing a preferable embodiment of the invention.

DESCRIPTION OF THE PREFERRED EMBODIMENTS

General

Figure 1:
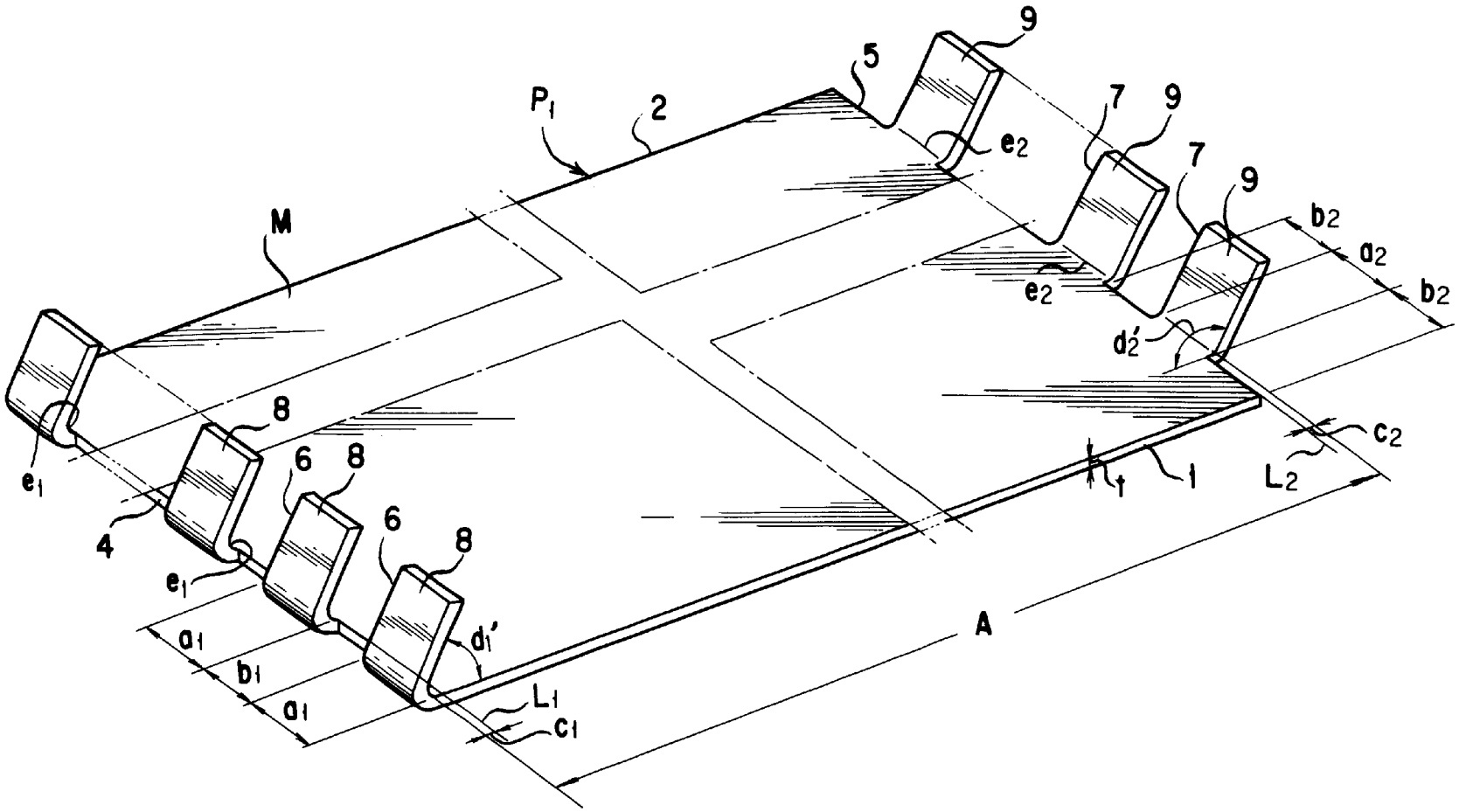
FIG. 1 is a partial perspective view of a printing plate embodying the principles of the present invention.
Figure 2:
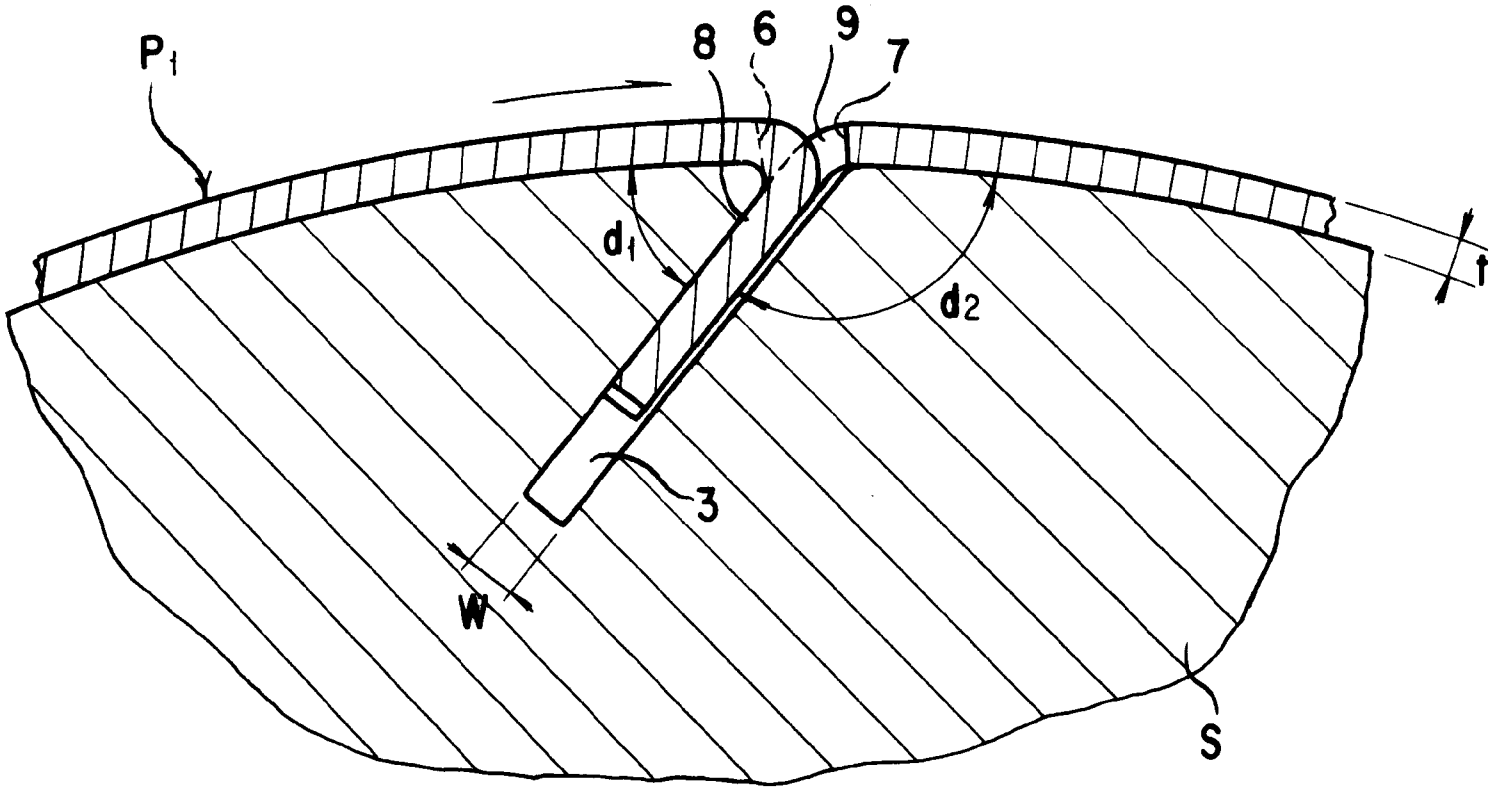
FIG. 2 is a fragmentary, enlarged sectional view showing the printing plate of FIG. 1 mounted to an associated plate cylinder, the view showing in particular the interdigitating series of lugs in the groove in the cylinder.
Figure 3:
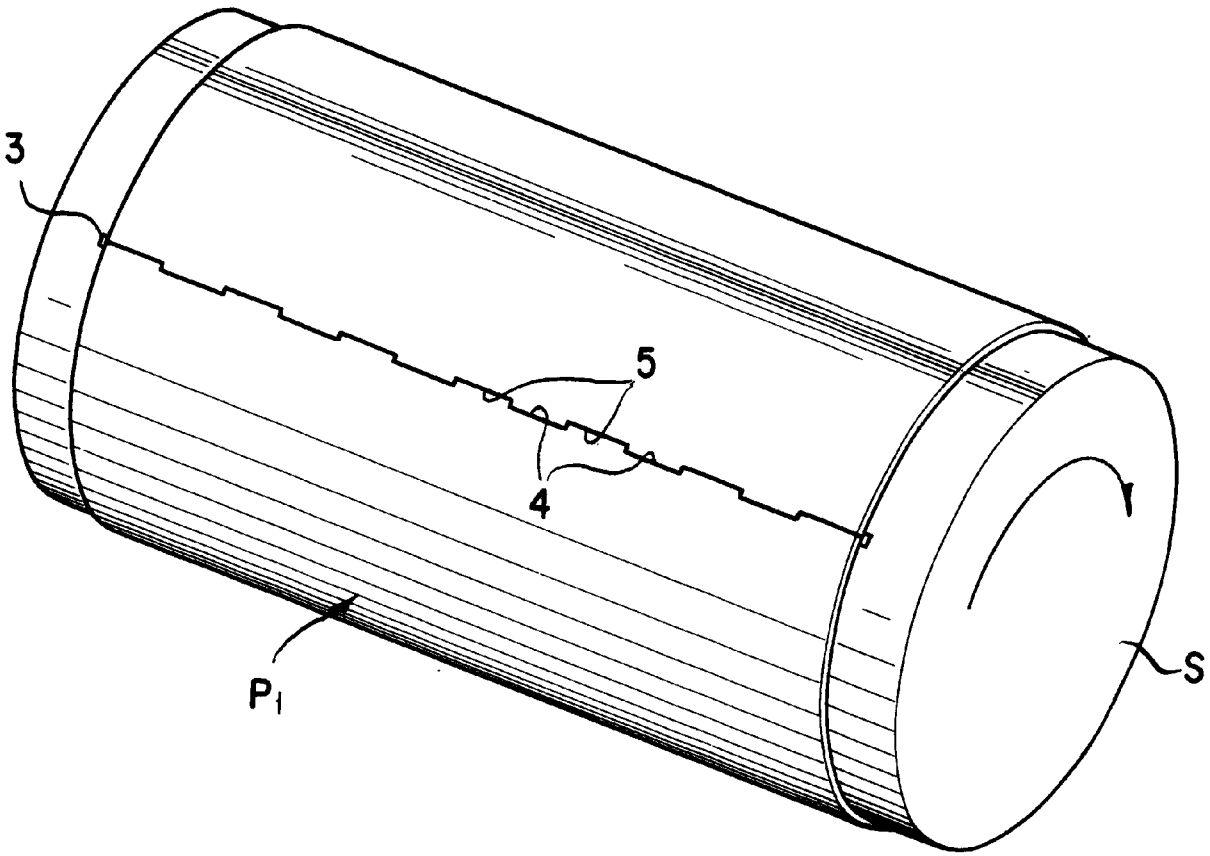
FIG. 3 is a perspective view showing the FIG. 1 printing plate mounted in place on the plate cylinder.

The printing plate $P_1$ shown in FIG. 1 by way of a representative embodiment of the invention takes the form of a generally rectangular piece of thin, flexible sheet material in order to be wrapped around a plate cylinder S, FIGS. 2 and 3, as pictured in these figures. The sheet material may be chosen from among those conventionally used for printing plates in general. The printing plate $P_1$ has a pair of opposite side edges 1 and 2 and a pair of opposite end edges 4 and 5. The end edges 4 and 5 are to meet when the printing plate is wrapped around the plate cylinder, so that they are herein referred to as the meeting edges.

The instant embodiment of the invention particularly concerns two interdigitating series of mounting lugs 8 and 9 on these meeting edges 4 and 5 of the printing plate $P_1$, as well as a groove 3 cut in the surface of the plate cylinder S for receiving the mounting lugs of the printing plate in an interdigitating state as the plate is mounted thereto.

Printing Plate

Referring more specifically to FIG. 1, the lugs 8 and 9 of the printing plate $P_1$ are formed by creating series of constantly spaced, rectangular-shaped recesses or spaces 6 and 7 in the opposite ends of the plate, thereby creating the series of constantly spaced, rectangular-shaped lugs 8 and 9, and by bending the lugs 8 on the meeting edge 4 into an acute angle $d_1'$, and the lugs 9 on the other meeting edge 5 into an obtuse angle $d_2'$, with respect to the major part M of the plate where a printing image is to be created. The angles $d_1'$ and $d_2'$ of the lugs 8 and 9 will be later explained in more detail in connection with the plate cylinder S.

The spaces 6 and 7 are cut from the opposite ends of the plate $P_1$ to the depths indicated by notional lines $L_1$ and $L_2$ drawn at right angles with the side edges 1 and 2, the meeting edges 4 and 5 being thus defined along these notional lines. The two series of lugs 8 and 9 are bent as above along notional lines $e_1$ and $e_2$, respectively, that are displaced, respectively, from the first mentioned notional lines $L_1$ and $L_2$ (i.e. from the meeting edges 4 and 5) away from the major part M (or toward the crests of the lugs) by distances $C_1$ and $C_2$ that are both approximately equal to the thickness t of the printing plate $P_1$. These outward deviations of the inside base ends $e_1$ and $e_2$, so to say, of the lugs 8 and 9 from the meeting edges 4 and 5 are necessary to cause the lugs to be inserted closely interfittingly in the plate cylinder groove 3.

Identical in shape, size and pitch, the two series of lugs 8 and 9 are staggered, that is, displaced from each other half their pitch in the transverse direction of the printing plate $P_1$. Thus the lugs 8 on the first meeting edge 4 are aligned with the spaces 7 on the other second meeting edge 5, and the lugs 9 on this second meeting edge with the spaces 6 on the first, in the longitudinal direction of the plate. The widths $a_1$ and $a_2$ of the lugs 8 and 9, which are the same, are somewhat less than the width $b_1$ and $b_2$ of the spaces 6 and 7, which are also the same. Consequently, the lugs 8 and 9 interdigitate when the printing plate $P_1$ is mounted to the plate cylinder S in a manner to be set forth subsequently.

Plate Cylinder

As will be understood from both FIGS. 2 and 3, the plate cylinder S has cut in its surface the groove 3 extending parallel to the cylinder axis for receiving the two interdigitating series of lugs 8 and 9 of the printing plate $P_1$. FIG. 3 clearly indicates that the depth direction of the groove is set at an angle to the radial direction of the plate cylinder in order to prevent accidental disengagement of the printing plate lugs 8 and 9. More specifically, with respect to the arrow-marked direction in which the cylinder is intended to rotate in operation of the printing plate in which it is incorporated, the upstream side of the groove 3 is at an acute angle $d_1$, and the downstream side of the groove at an obtuse angle $d_2$, to a plane tangent to the cylinder S at the groove.

A reference back to FIG. 1 will reveal that the lugs 8 on the meeting edge 4 of the printing plate $P_1$ are bent at the angle $d_1'$, and the lugs 9 on the other meeting edge 5 at the angle $d_2'$, to the major part M of the plate. These lug angles $d_1'$ and $d_2'$ are approximately equal to the groove angles $d_1$ and $d_2$, respectively.

With reference back to FIG. 2 the groove 3 in the plate cylinder S has its width W so determined as to permit insertion of the interdigitating lugs 8 and 9 of the printing plate $P_1$ with some clearance, neither too close to hamper smooth mounting of the plate nor too loose to allow accidental disengagement of the lugs from the groove. Being inserted interdigitatingly, the two series of lugs 8 and 9 are only as thick as the printing plate itself inside the groove 3.

Thus, speaking generally, the width W of the groove 3 needs to be only slightly more than the thickness t of the printing plate and can be less than twice the thickness t.

The length A, FIG. 1, of the major part M of the printing plate $P_1$ (more specifically, distance between the inside bases or roots $e_1$ and $e_2$ of the lugs 8 and 9) is approximately equal to the circumference of the plate cylinder S minus the width of the groove 3 at its entrance end. The major part M of the printing plate $P_1$ is therefore closely wrapped around the plate cylinder S upon full insertion of the interdigitating lugs 8 and 9 in the groove 3.

Method of Mounting the Plate to the Cylinder

It is understood that the plate cylinder S, to which the printing plate $P_1$ is to be mounted in the manner to be set forth hereafter, is already mounted in position on the printing press, ready for rotation in the direction of the arrow in FIG. 2.

The acutely bent lugs 8 of the printing plate $P_1$ should first be hooked onto the acute-angled edge of the plate cylinder S on one side of the groove 3, rather than the other way around, in such a way that these lugs are fully inserted in the groove. Then the plate cylinder S may be set into low speed rotation in the arrow-marked direction thereby causing the printing plate $P_1$ to be wrapped around the cylinder, and out of rotation as the plate completely enwraps the cylinder. The mounting of the plate $P_1$ to the cylinder S will be completed simply as the obtuse-angled lugs 9 of the plate are then inserted in the groove 3 into a interdigitating relationship with the previously inserted lugs 8, that is, with the lugs 9 received in the spaces 6 between the lugs 8, and these lugs 8 in the spaces 7 between the lugs 9. The lugs 9 will be readily insertable in the groove 3 because these lugs are bent at the obtuse angle $d_2'$ and inserted in the groove from its obtuse-angled side.

It will be appreciated that, hooked onto the acute-angled side of the groove 3, the acute-angled lugs 8 of the printing plate $P_1$ will stay firmly hooked as the plate cylinder S rotates in the predetermined direction. The leading side of the groove 3 must therefore be acutely angled with respect to the direction of cylinder rotation in order to assure positive engagement of the lugs 8 in the groove 3 during the cylinder rotation. The subsequent insertion of the obtuse-angled lugs 9 in the groove 3 from its obtuse-angled side will also be far easier than if this side were acute- or right-angled.

Additionally, as has been set forth with reference to FIG. 1, the inside base ends $e_1$ and $e_2$ of both series of lugs 8 and 9 on the printing plate $P_1$ are displaced, respectively, from the notional lines $L_1$ and $L_2$, or from the meeting edges 4 and 5, toward the crests of the lugs by the distances $C_1$ and $C_2$ that are both equal to the thickness t of the plate. Therefore, as will be understood from a closer study of FIG. 2, the obtusely angled lugs 9 will be smoothly insertable in the spaces 6 between the acutely angled lugs 8 as above, without being hampered in any way by those parts of the meeting edge 4 which bound the bases of the spaces 6.

Still further, the lugs 9 will be fully inserted in the groove 3 as the bases of the spaces 7 therebetween, or the meeting edge 5, will not interfere with the bases of the lugs 8. Thus the printing plate $P_1$ with the interdigitating lugs 8 and 9 will provide a practically unbroken surface over the plate cylinder.

Second Form

Figure 4:
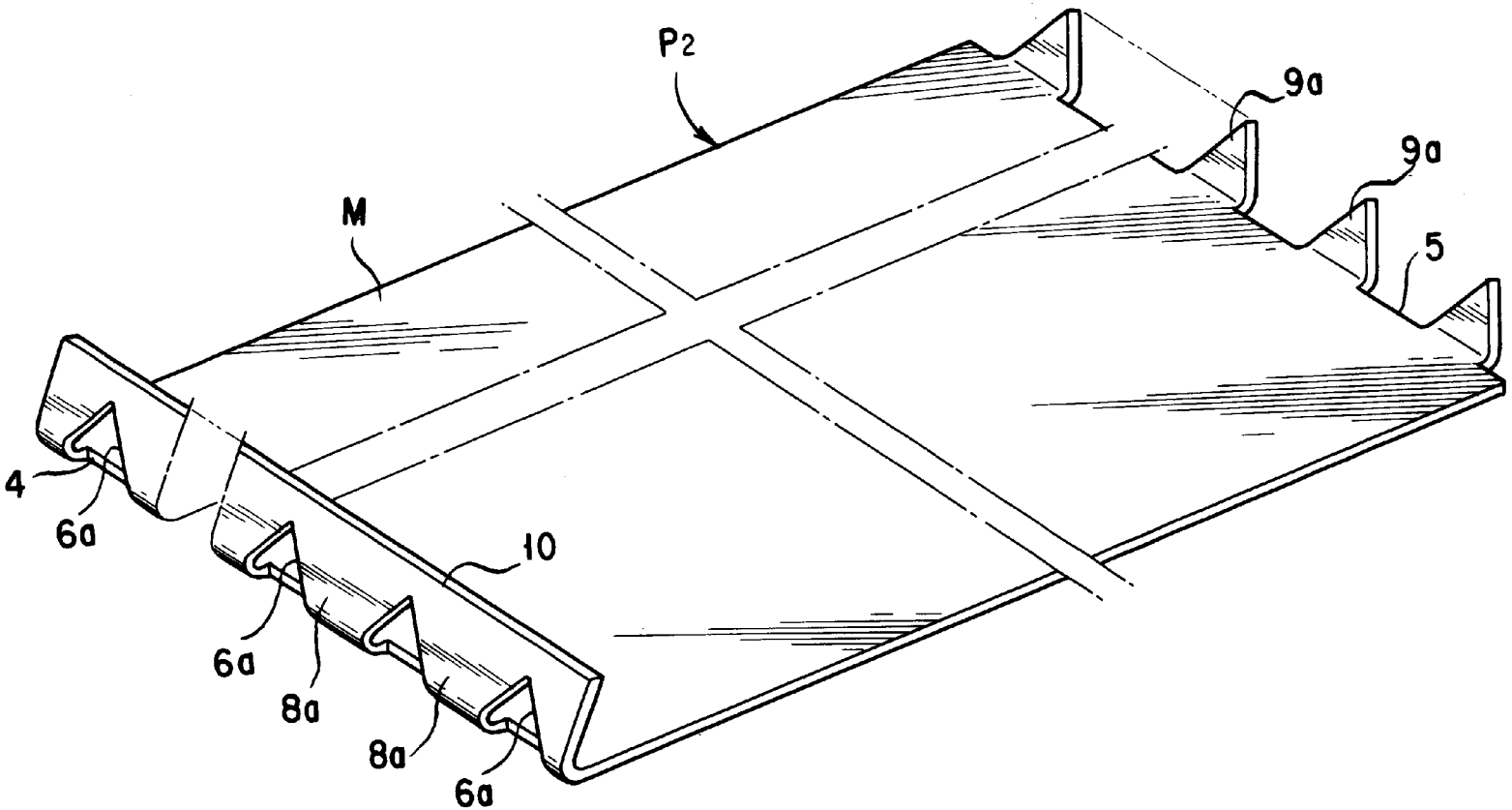
FIG. 4 is a view similar to FIG. 1 but showing an alternative form of printing plate according to this invention.

FIG. 4 shows another preferred form of printing plate $P_2$. On one meeting edge 4 of this printing plate $P_2$ there are formed a series of lugs 8*a* which are arranged at constant spacings and which are interconnected by a crossbar or tie 10 to define a series of constantly spaced, closed spaces 6*a* of triangular shape. A series of discrete triangular-shaped lugs 9*a* are formed at constant spacings on the other meeting edge 5 of the plate. The triangular lugs 9*a* are similar in shape to, but less in size than, the spaces 6*a* in order to be received therein when the plate is mounted to the plate cylinder.

Although not specifically indicated in FIG. 4, it is understood that the interconnected lugs 8*a* of the printing plate $P_2$ are bent at an acute angle, and the discrete triangular lugs 9*a* at an obtuse angle, to the major part M of the plate $P_2$ just like the lugs 8 and 9, respectively, of the first disclosed embodiment of the invention. It is also understood that this printing plate $P_2$ is for use with the plate cylinder of the same construction as that shown at S in FIGS. 2 and 3, having the angled groove 3 with a width less than twice the thickness of the printing plate.

The printing plate $P_2$ may be mounted to the plate cylinder S the same way as the first disclosed printing plate $P_1$ is. Inserted in the groove 3, FIG. 2, in the plate cylinder S after wrapping the printing plate $P_2$ around the cylinder, the discrete lugs 9*a* will be smoothly received in the spaces 6*a* between the interconnected lugs 8*a* which have been first inserted in the groove. The lugs 8*a* and 9*a* will therefore be in a interdigitating or interfitting relationship in the groove 3.

Although the present invention has been hereinbefore described very specifically and as adapted for a rotary press, it is not desired that the invention be limited by the exact details of this disclosure. A variety of modifications and alterations of the illustrated embodiments may be made in order to conform to design preferences or to the requirements of each specific application. For instance, the lugs on the meeting edges of the printing plate may not necessarily be rectangular or triangular in shape as in the illustrated embodiments but trapezoid, semicircular, or otherwise provided that they are capable of interdigitating or interfitting when inserted in the groove in the plate cylinder.

All these and other modifications or alterations are intended in the foregoing disclosure. It is therefore appropriate that the invention be construed broadly and in a manner consistent with the fair meaning or proper scope of the claims which follow.

What is claimed is:

1. A combination of a plate cylinder and a printing plate;

the printing plate having a major part having a pair of meeting edges and two staggered series of lugs which are formed on the pair of meeting edges of the major part thereof and which are bent at acute and obtuse angles, respectively, with respect to the major part, and the plate cylinder having formed therein a single groove engaging with the two series of lugs, extending parallel to the cylinder axis and having a width less than twice the thickness of the printing plate, the groove having a depth direction thereof set at such an angle to a plane tangent to the plate cylinder at the groove that the opposite sides of the groove are at approximately the same acute and obtuse angles, respectively, to said plane as the two series of lugs are to the major part of the printing plate.

2. A printing plate configured for use with a plate cylinder having formed therein a groove extending parallel to the cylinder axis, the groove having a depth direction thereof set at an angle to a plane tangent to the plate cylinder at the groove so that opposite sides of the groove are at acute and obtuse angles, respectively, to said plane, the printing plate being generally in the form of a piece of flexible sheet material integrally comprising:

(a) a major part having a pair of meeting edges which are configured to meet each other when the printing plate is wrapped around the plate cylinder; and (b) two series of lugs formed on the meeting edges of the major part and bent with respect to the major part for engagement in the groove in the plate cylinder;

(c) the series of lugs configured for interfitting interengagement with each other in the groove in the plate cylinder, wherein the two series of lugs of the printing plate are bent with respect to the major part at approximately the same acute and obtuse angles, respectively, as the opposite sides of the groove are to said plane, and wherein the two series of lugs on the major part have notional base lines displaced from the meeting edges of the major part in directions away from the major part by distances approximately equal to the thickness of the printing plate, and the two series of lugs are bent along said notional base lines.

3. In combination:

(A) a plate cylinder having formed therein a groove extending parallel to the cylinder axis and having a depth direction thereof set at an angle to a plane tangent to the plate cylinder at the groove so that the opposite sides of the groove are at acute and obtuse angles, respectively, to said plane; and (B) a printing plate generally in the form of a piece of flexible sheet material integrally comprising:

(a) a major part having a pair of meeting edges which meet each other when the printing plate is wrapped around the plate cylinder;

(b) a first series of lugs formed on one of the meeting edges of the major part and bent with respect to the major part at approximately the same acute angle as one side of the groove in the plate cylinder is to said plane, the first series of lugs being engaged in the groove in the plate cylinder from said one side thereof; and (c) a second series of lugs formed on the other of the meeting edges of the major part and bent with respect to the major part at approximately the same obtuse angle as the other side of the groove in the plate cylinder is to said plane, the second series of lugs being engaged in the groove in the plate cylinder from said other side thereof;

(C) the first and the second series of lugs of the printing plate being staggered for interfitting interengagement with each other in the groove in the plate cylinder.

4. A method of mounting a printing plate to a plate cylinder which comprises:

(a) providing a plate cylinder having formed therein a groove extending parallel to the cylinder axis and having a depth direction thereof set at an angle to a plane tangent to the plate cylinder at the groove so that, with respect to a prescribed direction of rotation of the plate cylinder, a leading side of the groove is at an acute angle, and a trailing side thereof at an obtuse angle, with respect to said plane;

(b) providing a printing plate having two staggered series of spaced lugs formed on a pair of meeting edges of a major part and bent at approximately the same acute and obtuse angles, respectively, to the major part as the opposite sides of the groove are to said plane;

(c) hooking the acute-angled series of lugs of the printing plate onto the acute-angled leading side of the groove in the plate cylinder by inserting the acute-angled series of lugs in the groove;

(d) wrapping the printing plate around the plate cylinder by rotating the plate cylinder in the prescribed direction; and (e) inserting the obtuse-angled series of lugs of the printing plate in the groove in the plate cylinder into interdigitating relationship with the acute-angled series of lugs.

* * * * *